US006789751B1

(12) United States Patent
Fan

(10) Patent No.: US 6,789,751 B1
(45) Date of Patent: Sep. 14, 2004

(54) COLLAPSIBLE HANDLE FOR A SHOWER HEAD

(75) Inventor: Chen-Yueh Fan, Taipei (TW)

(73) Assignee: Winner Double-H Co., Ltd., Taipei (TW)

( * ) Notice: Subject to any disclaimer, the term of this patent is extended or adjusted under 35 U.S.C. 154(b) by 0 days.

(21) Appl. No.: 10/395,170

(22) Filed: Mar. 25, 2003

(51) Int. Cl.[7] ..... B05B 9/01

(52) U.S. Cl. ..... 239/525; 239/532; 239/587.1; 138/114; 285/303

(58) Field of Search ..... 239/525, 530, 239/532, 587.1; 285/302, 303, 305; 138/114, 177

(56) References Cited

U.S. PATENT DOCUMENTS 4,091,998 A * 5/1978 Peterson ..... 239/283
4,458,369 A * 7/1984 Santi ..... 4/596
5,032,015 A * 7/1991 Christianson ..... 359/512
6,370,713 B2 * 4/2002 Bosio ..... 4/677
6,502,768 B2 * 1/2003 Chang ..... 239/526
6,611,971 B1 * 9/2003 Antoniello et al. ..... 4/570
6,626,378 B2 * 9/2003 Sasaki et al. ..... 239/310
6,643,862 B2 * 11/2003 Aitken ..... 4/601
6,730,051 B2 * 5/2004 Lin ..... 601/112

FOREIGN PATENT DOCUMENTS

JP 02002102098 A * 4/2002

* cited by examiner

*Primary Examiner*—William E. Tapolcai
*Assistant Examiner*—Mohammad M. Ali
(74) *Attorney, Agent, or Firm*—Rosenberg, Klein & Lee

(57) ABSTRACT

A collapsible handle for use with a shower head includes a hollow tubular handle provided with a pair of oppositely formed tracks formed on an inner face of the tubular handle. An inner tube is selectively and slidably received in the tubular handle so that the inner tube is able to extend out of the tubular handle. The inner tube has a pair of oppositely formed ribs on an outer face of the inner tube to correspond to the pair of tracks such that after the ribs are received in the corresponding tracks, the inner tube is able to slide in and extend out of the tubular handle. A retaining device is movably mounted on the tubular handle, so that relative position between the inner tube and the tubular handle is determined by the retaining device and overall length of a handle is adjustable.

18 Claims, 8 Drawing Sheets

COLLAPSIBLE HANDLE FOR A SHOWER HEAD

BACKGROUND OF THE INVENTION

1. Field of the Invention

The present invention relates to a collapsible handle, and more particularly to a collapsible handle for a shower head so that the user is able to readily reach any portion of the user's body.

2. Description of Related Art

When taking a shower, the user holds the handle of a conventional shower head so as to maneuver the shower head to a designated position of the user's body. For most users, using the conventional shower head is easy. However, for those who are senior citizens or are disabled, using the conventional shower head often is limited by the retrogression of physical functions. Some users may suffer from the loss of flexibility of elbows so that the users are not able to reach the rear portion of the body. Some other users may suffer from backaches so that they are not able to reach the bottom portion of the body while taking a shower.

To overcome the shortcomings, the present invention tends to provide an improved shower head with a collapsible handle to mitigate and obviate the aforementioned problems.

SUMMARY OF THE INVENTION

The primary objective of the present invention is to provide an improved collapsible handle for a shower head so that the user is able to readily reach any portion of the body.

Other objects, advantages and novel features of the invention will become more apparent from the following detailed description when taken in conjunction with the accompanying drawings.

DETAILED DESCRIPTION OF THE PREFERRED EMBODIMENT

Figure 1:
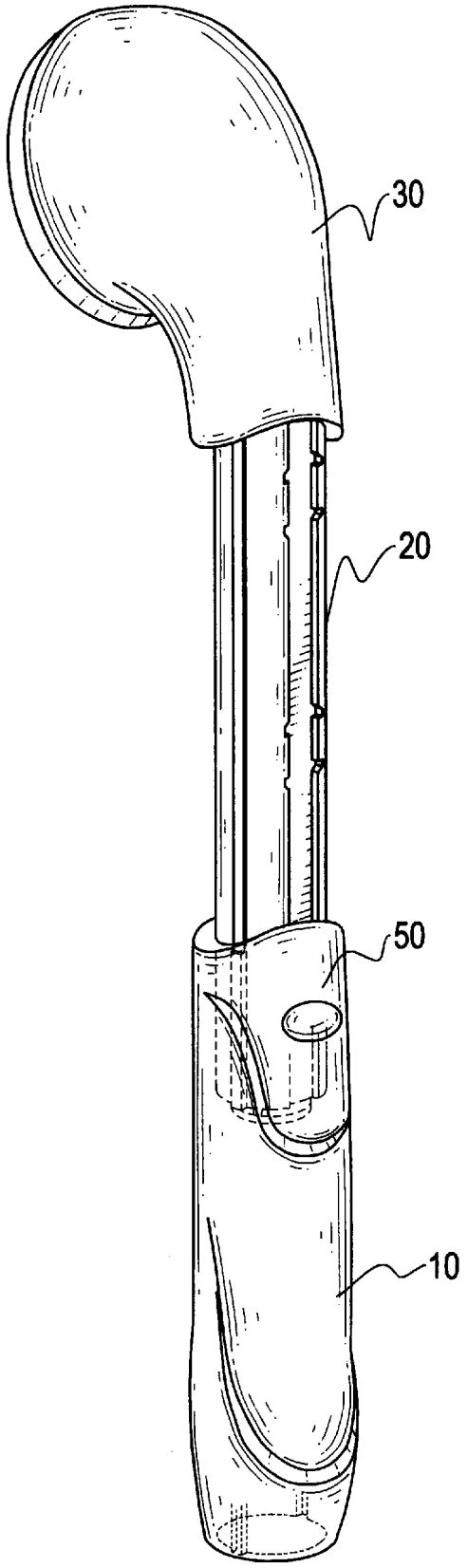
FIG. 1 is a perspective view of the collapsible handle for use with a shower head.

With reference to FIG. 1, a shower head includes a tubular handle (10), an inner tube (20), a nozzle (30) and a retaining device (50).

Figure 2:
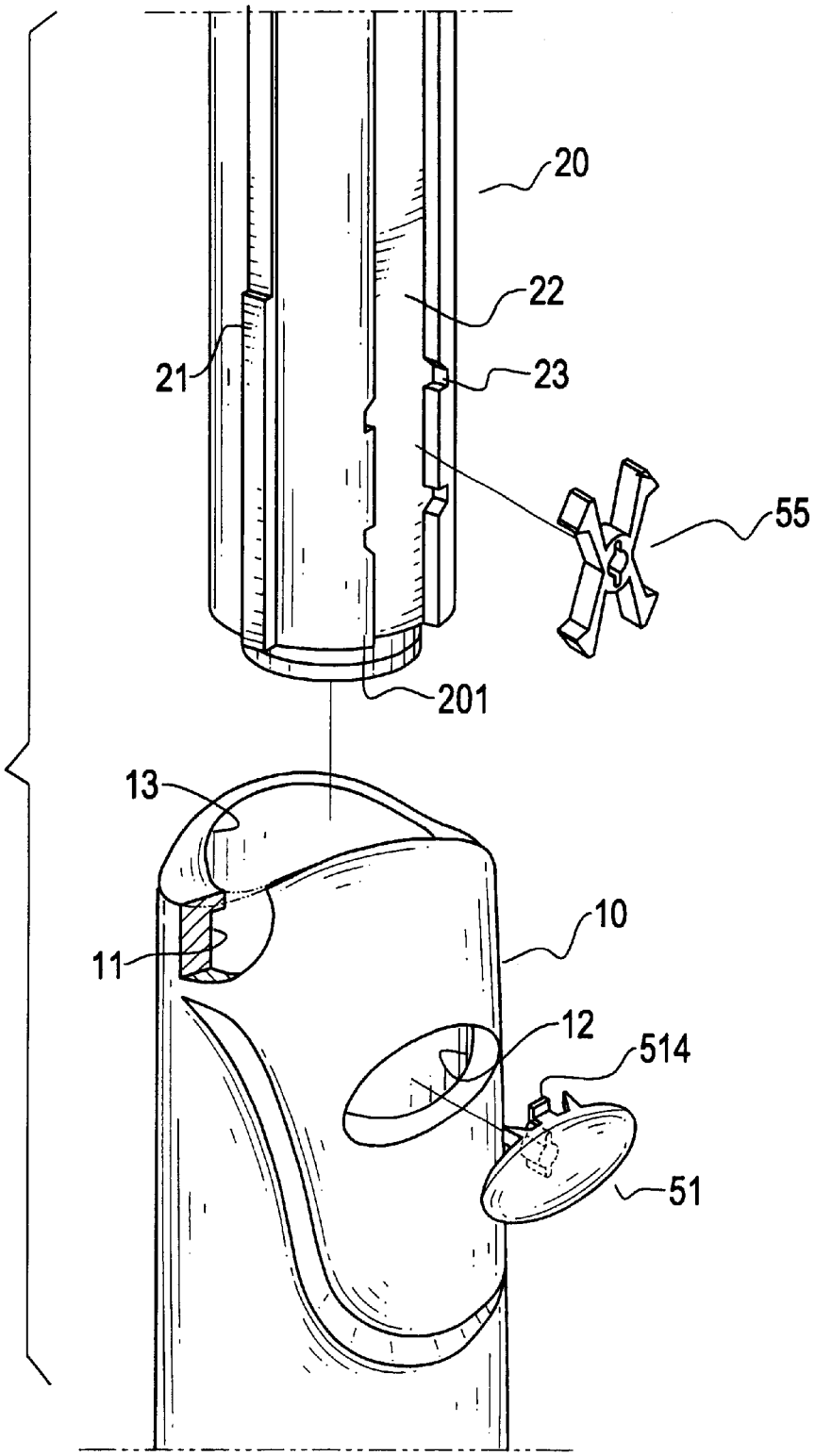
FIG. 2 is an exploded perspective view of the collapsible handle for the shower head in FIG. 1.

With reference to FIG. 2, the tubular handle (10) has a pair of tracks (11) oppositely formed on an inner face of the tubular handle (10). A through hole (12) is defined through a periphery of the tubular handle (10). A flange (13) is formed on a peripheral edge of the tubular handle (10).

The inner tube (20) has two open ends, one is adapted to connect to a water source and the other is adapted to connect to the nozzle (30). The inner tube (20) further has a pair of ribs (21) oppositely formed on an outer periphery of the inner tube (20) to correspond to the pair of tracks (11) of the tubular handle (10), a passage (22) formed on the outer periphery of the inner tube (20) and sandwiched between the two ribs (21), and multiple sets of notches (23) formed on opposite side walls defining the passage (22), wherein one set of the notches (23) includes four notches (23). The inner tube (20) further has a head (201) formed on a distal end of the inner tube (20) to correspond to the flange (13) of the tubular handle (10).

Because the structure of the nozzle (30) is conventional in the art, detailed description thereof is thus omitted.

The retaining device (50) includes a controlling button (51) corresponding to the through hole (12) of the tubular handle (10) and a retaining element (55) corresponding to the passage (22) of the inner tube (20).

Figure 3:
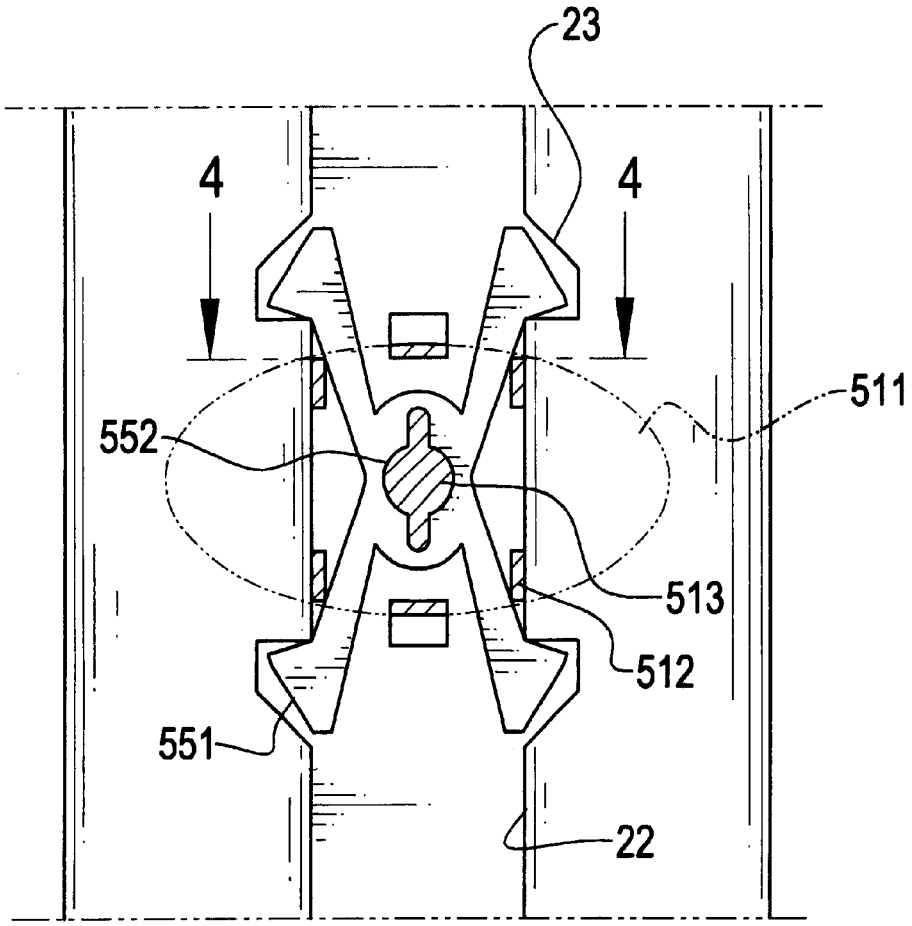
FIG. 3 is a top plan view of the retaining element received in the handle.

With reference to FIG. 3 and still taking FIG. 2 for reference, the controlling button (51) has a cap (511) with a size slightly smaller than that of the through hole (12), four wedged legs (512) extending downward from a bottom face of the cap (511), a positioning block (513) integrally formed with the bottom face of the cap (511) and extending out from a center of the wedged legs (512), and two L-shaped positioning plates (514) oppositely formed on a peripheral edge of the cap (511).

The retaining element (55) includes four hooks (551) integrally extending out to correspond to the wedged legs (512) and one set of the notches (23) and a positioning hole (552) formed on a center of the retaining element (55) to correspond to the positioning block (513).

In assembly, the inner tube (20) is inserted into the tubular handle (10) with the ribs (21) received in the corresponding tracks (11) such that the inner tube (20) is slidable with respect to the tubular handle (10). Furthermore, due to a size of the head (201) being larger than that of the flange (13), the inner tube (20) is retained in the tubular handle (10). After the assembly between the inner tube (20) and the tubular handle (10), the retaining element (55) is placed in the passage (22) to have the four hooks (551) to be respectively received in the notches (23).

Thereafter, the controlling button (51) is inserted into the through hole (12). Because the size of the cap (511) is smaller than that of the through hole (12), the controlling button (51) is able to move in the through hole (12). Furthermore, because the positioning plates (514) are made of plastic, the positioning plates (514) are deformable, such that after extending the four wedged legs (512) into the through hole (12), the two positioning plates (514) are able to clamp a peripheral edge defining the through hole (12) to secure the controlling button (51) to the tubular handle (10).

Figure 4:
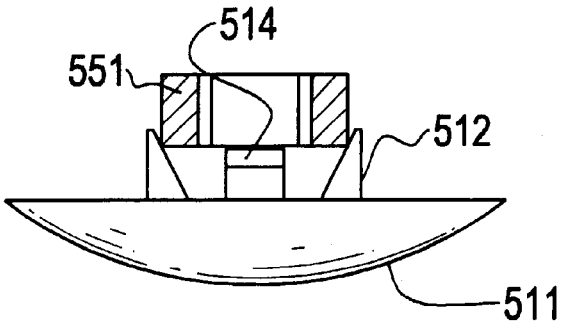
FIG. 4 is a cross sectional view showing the structure of the controlling button.

With reference to FIG. 4 and still taking FIG. 3 for reference, it is noted that after the four wedged legs (512) are extended into the through hole (512), each of the four wedged legs (512) engages with a corresponding one of the four hooks (551) and the positioning block (513) is received in the corresponding positioning hole (552). In order to have the hooks (551) to move accordingly every time the cap (511) is pressed downward toward the through hole (12), each of the four wedged legs (512) engages with an outer face of each of the four hooks (551).

Figure 5:
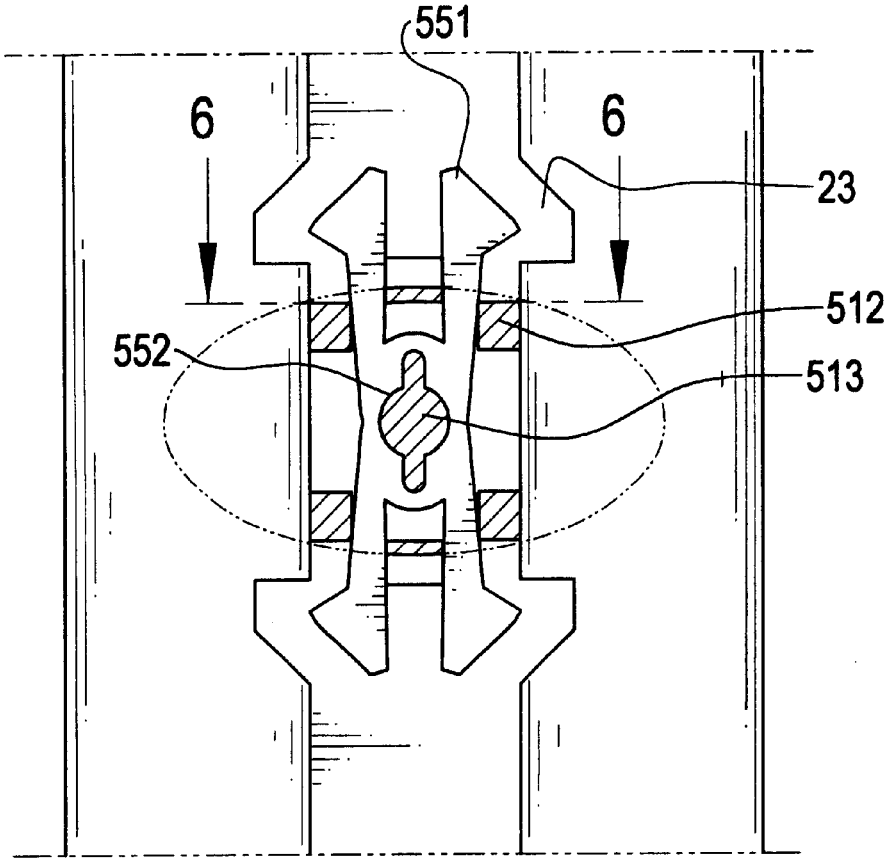
FIG. 5 is a schematic view showing the deformation of the retaining element caused by the movement of the controlling button.
Figure 6:
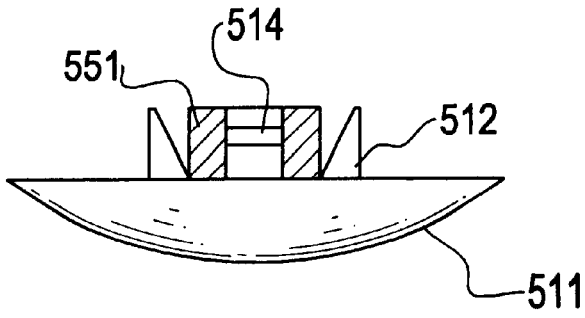
FIG. 6 is a schematic view showing the relationship between the controlling button and the retaining element after downward movement of the controlling button.

With reference to FIGS. 5 and 6 and comparing the status in FIGS. 3 and 4, it is noted that before the cap (511) is pressed downward toward the through hole (12), the four wedged legs (512) engage with the outer face of the four hooks (551) and the cap (511) is away from engagement with the retaining element (55). However, after the cap (511) is pressed downward toward the through hole (12), the cap (511) engages with the retaining element (55). Meanwhile, the four wedged legs (512) force the four hooks (551) to leave the corresponding notches (23). Therefore, the user is able to hold the tubular handle (10) with the cap (511) pressed downward to change the overall length of the handle of the shower head. With the adjustment ability, the user is able to extend the nozzle (30) to any portion of the body.

Figure 7:
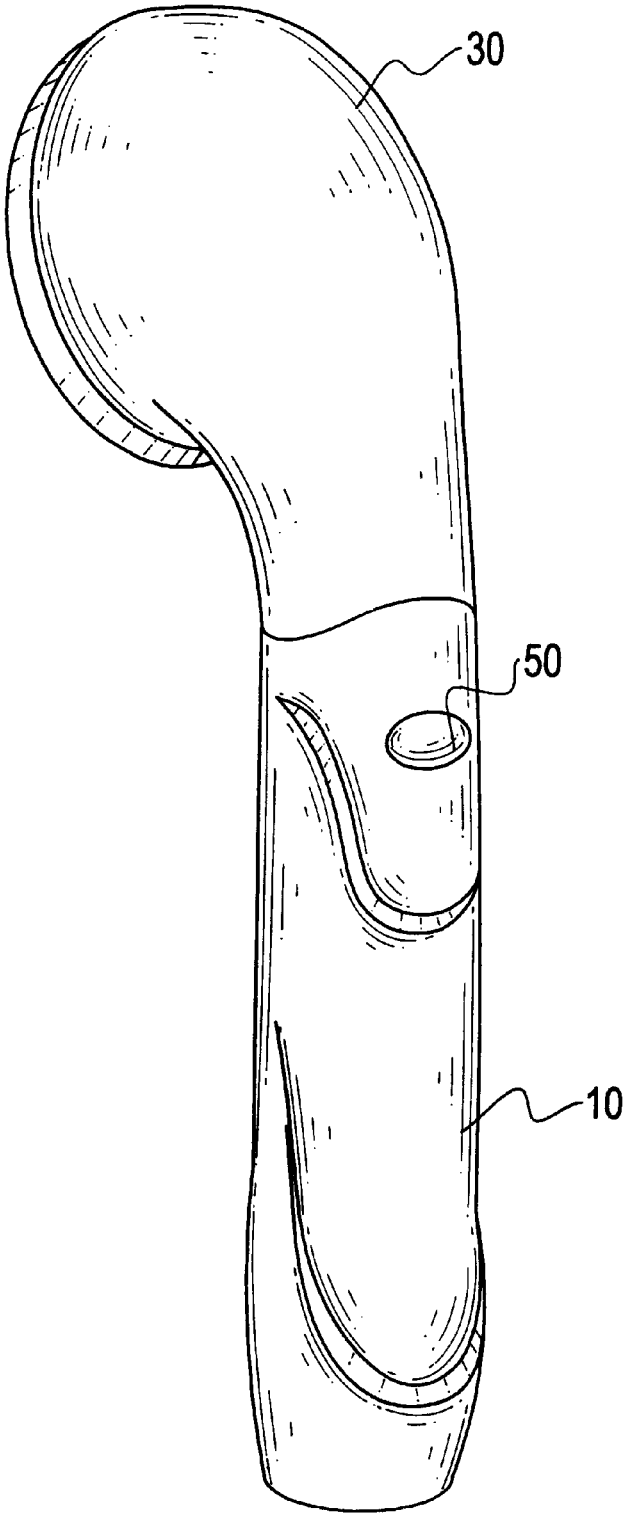
FIG. 7 is a perspective view showing that the collapsible handle of the present invention is retracted.

With reference to FIG. 7, after the use of the shower head with the collapsible handle of the present invention, the user is able to have the inner tube (20) fully received in the tubular handle (10) to become a conventional shower head again.

Figure 8:
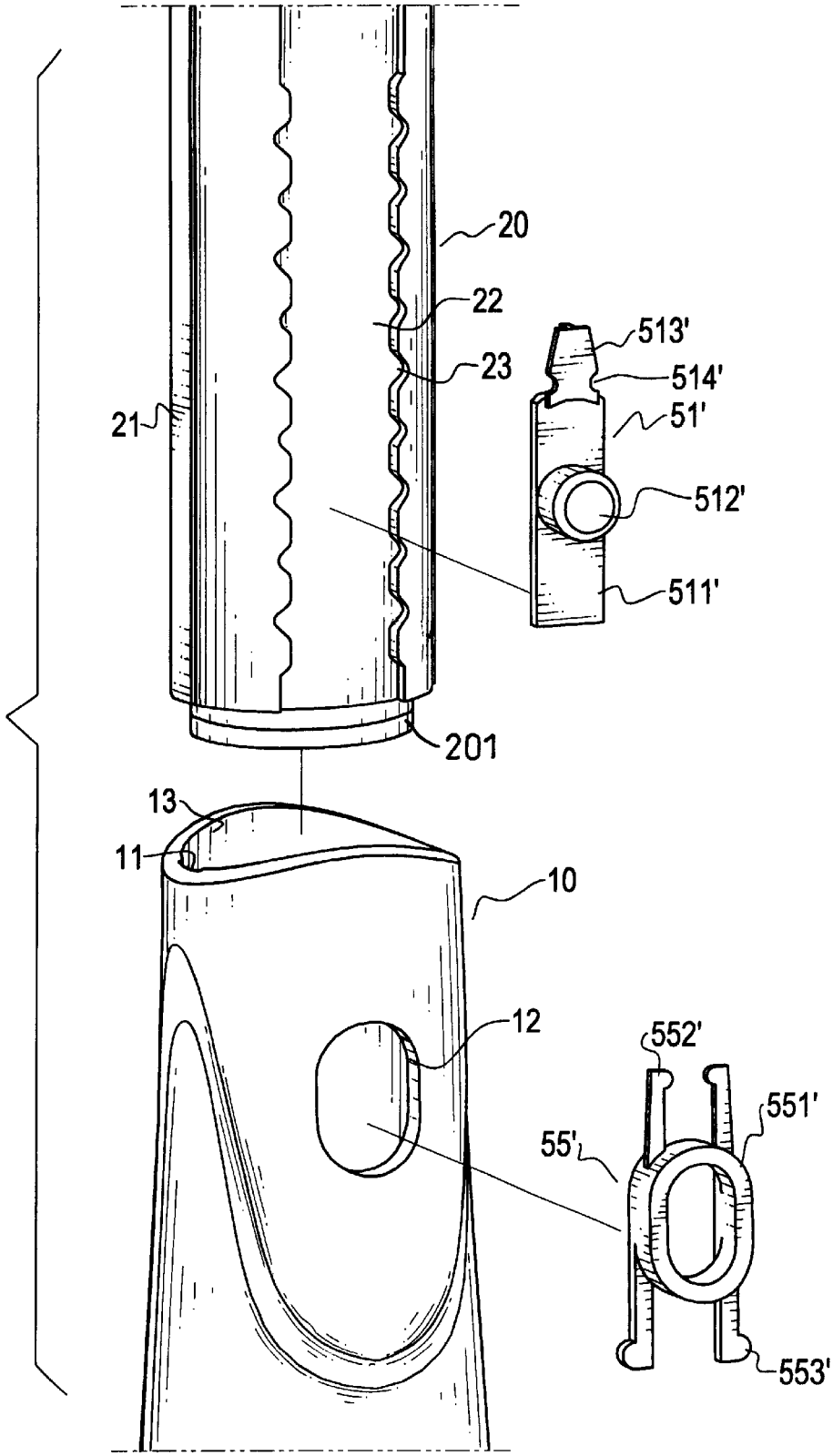
FIG. 8 is an exploded perspective view of a second preferred embodiment of the present invention.

With reference to FIG. 8, a second embodiment of the present invention is shown and has a tubular handle (10), an inner tube (20) and a retaining device.

The tubular handle (10) has a pair of tracks (11) oppositely formed on an inner face of the tubular handle (10). A through hole (12) is defined through a periphery of the tubular handle (10). A flange (13) is formed on a peripheral edge of the tubular handle (10).

The inner tube (20) has two open ends, one is adapted to connect to a water source and the other is adapted to connect to the nozzle (30) (as shown in FIG. 1). The inner tube (20) further has a pair of ribs (21) oppositely formed on an outer periphery of the inner tube (20) to correspond to the pair of tracks (11) of the tubular handle (10), a passage (22) formed on the outer periphery of the inner tube (20) and sandwiched between the two ribs (21), and multiple sets of notches (23) formed on opposite side walls defining the passage (22). The inner tube (20) further has a head (201) formed on a distal end of the inner tube (20) to correspond to the flange (13) of the tubular handle (10).

The retaining device has a controlling button (51') and a retaining element (55'). The controlling button (51') has a rectangular body (511'), a button (512') formed on a mediate portion of the body (511'), an extension (513') extending out from one distal end of the body (511') and a pair of cutouts (514') oppositely formed on the extension (513').

The retaining element (55') includes a hollow rim (551') to correspond to the button (512'), a pair of first claws (552') corresponding to the pair of cutouts (514') of the extension (513') and a pair of second claws (553') oppositely extending relative to the first claws (552') from the hollow rim (551) to correspond to the notches (23).

Figure 9:
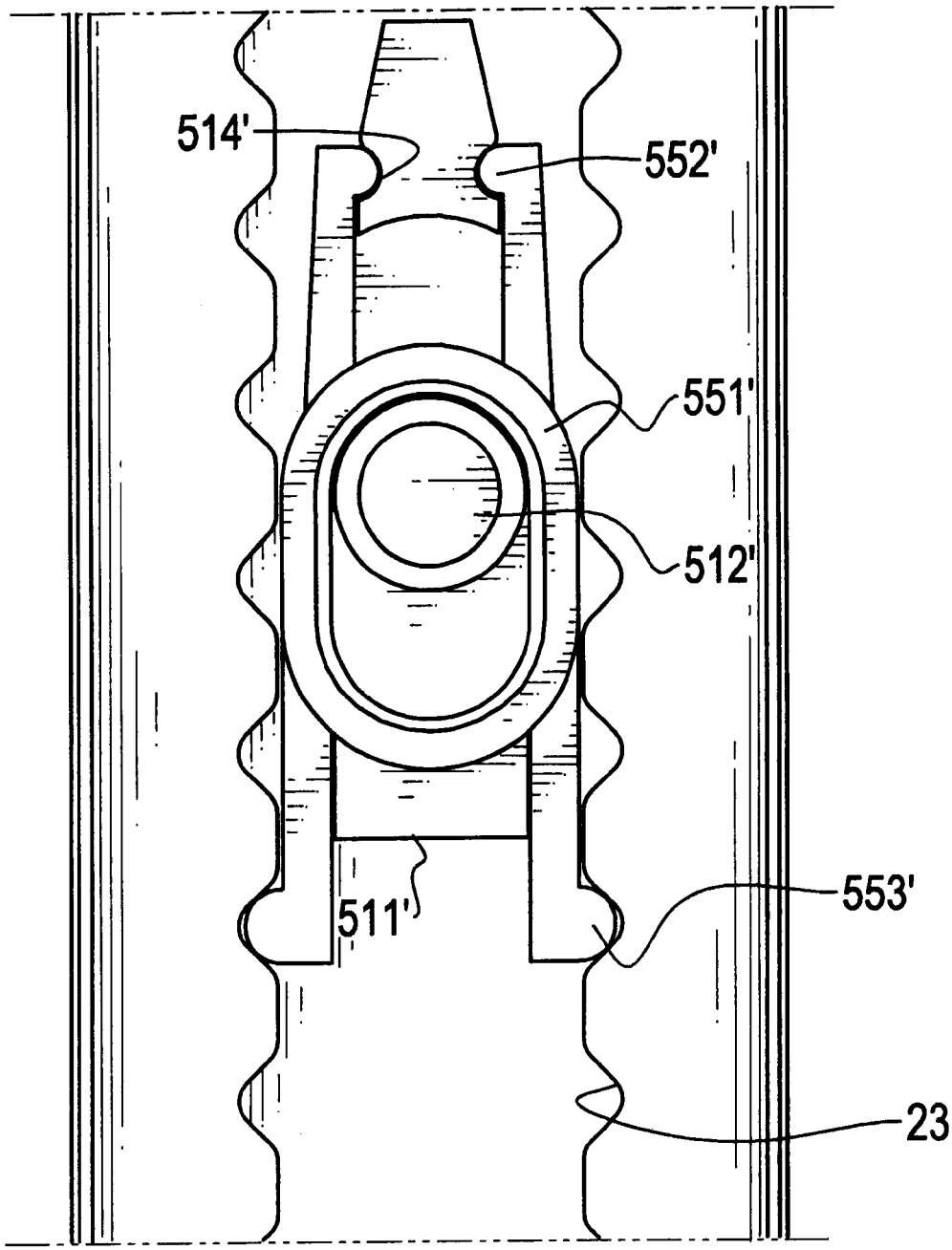
FIG. 9 is a schematic view of the second embodiment in assembly.
Figure 10:
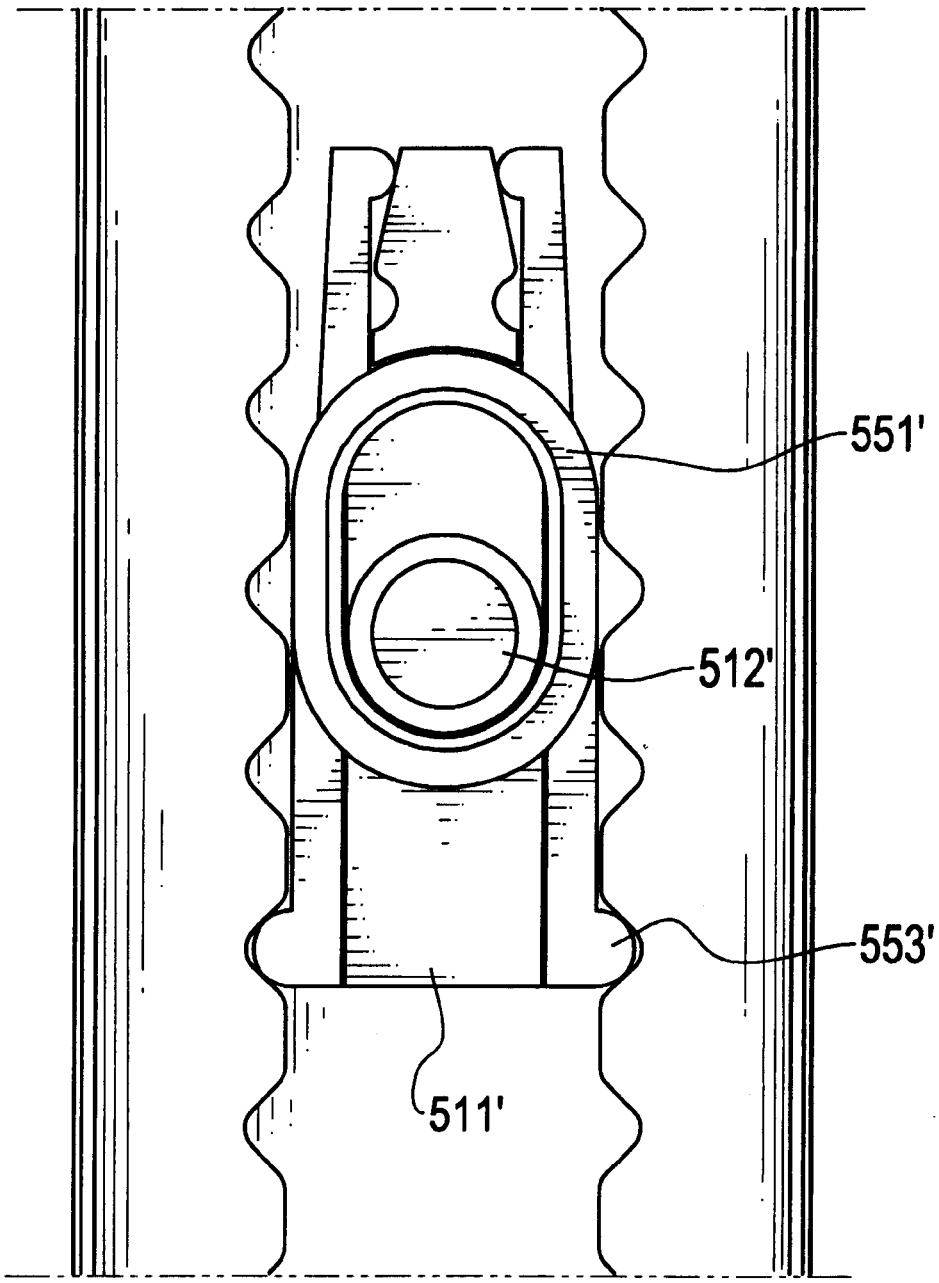
FIG. 10 is a schematic view showing the movement of the controlling button causes a secure engagement between the tubular handle and the inner tube.

With reference to FIGS. 9 and 10, when the embodiment of the present invention is in assembly, the button (512') is received in the hollow rim (551') and then the combination of the controlling button (51') and the retaining element (55') is placed in the passage (22) with the rim (551') and the button (512') extending out from the through hole (12). It is noted that the hollow rim (551') has a length larger than that of the button (512') so that after the button (512') is received in the hollow rim (551'), the button (512') can still move freely in the hollow rim (551'). After placing the combination of the controlling button (51') and the retaining element (55') in the passage (22), the first claws (552') clamp the cutouts (514') respectively and the rectangular body (511') is received between the second claws (553').

When the two first claws (552') clamp the cutouts (514'), the combination of the controlling button (51') and the retaining element (55') is able to travel in the passage (22) because the resilience of the second claws (553') which are made of plastic. That is, when the user pushes the button (512') to move the button (512') in the hollow rim (551') to have the first claws (552') clamp the cutouts (514'), relative position of the handle (10) to the inner tube (20) is changeable and therefore the length of the sprinkler is changed.

However, when the user pushes the button (512') to move the button (512') in the hollow rim (551') to have the first claws (552') to leave limit from the cutouts (514') and to allow the rectangular body (511') to be received between the two second claws (553'), because the rectangular body (511') blocks the resilience between the two second claws (553'), relative position between the handle (10) and the inner tube (20) is fixed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A collapsible handle in a shower head having a nozzle, the collapsible handle comprising:

a hollow tubular handle provided with a pair of oppositely formed tracks formed on an inner face of the tubular handle;

an inner tube selectively and slidably received in the tubular handle so that the inner tube is able to extend out of the tubular handle, the inner tube having a pair of oppositely formed ribs on an outer face of the inner tube to correspond to the pair of tracks such that after the ribs are received in the corresponding tracks, the inner tube is able to slide in and extend out of the tubular handle; and a retaining device movably mounted on the tubular handle to control the slidable movement of the inner tube relative to the tubular handle, whereby a relative position between the inner tube and the tubular handle is determined by the retaining device so that an overall length of a handle of the shower head is able to be adjusted.

2. The collapsible handle as claimed in claim 1, wherein the retaining device comprises a controlling button movably mounted on the tubular handle and a retaining element driven by the controlling button, wherein the retaining element is sandwiched between the inner tube and the tubular handle.

3. The collapsible handle as claimed in claim 2, wherein the tubular handle has a through hole defined through a periphery of the tubular handle to movably receive therein the cap.

4. The collapsible handle as claimed in claim 2, wherein the inner tube has a passage defined in an outer face of the inner tube to receive therein the retaining element.

5. The collapsible handle as claimed in claim 3, wherein the inner tube has a passage defined in an outer face of the inner tube to receive therein the retaining element.

6. The collapsible handle as claimed in claim 3, wherein the controlling button has a cap, at least two wedged legs extending out from a bottom face of the cap and at least two positioning plates oppositely formed on the bottom face of the cap to clamp a peripheral edge defining the through hole of the tubular handle, wherein the retaining element comprises at least two oppositely formed hooks corresponding to the at least two wedged legs such that the at least two wedged legs are able to drive the at least two hooks to move.

7. The collapsible handle as claimed in claim 4, wherein the controlling button has a cap, at least two wedged legs extending out from a bottom face of the cap and at least two positioning plates oppositely formed on the bottom face of the cap to clamp a peripheral edge defining the through hole of the tubular handle, wherein the retaining element comprises at least two oppositely formed hooks corresponding to the at least two wedged legs such that the at least two wedged legs are able to drive the at least two hooks to move.

8. The collapsible handle as claimed in claim 5, wherein multiple sets of notches are formed on opposite walls defining the passage to correspond to the retaining element.

9. The collapsible handle as claimed in claim 7, wherein multiple sets of notches are formed on opposite walls defining the passage to correspond to the at least two hooks of the retaining element.

10. The collapsible handle as claimed in claim 6, wherein the controlling button further has a positioning block integrally formed on the bottom face of the cap and the retaining element has a positioning hole defined to correspond to the positioning block such that the positioning block is able to be received in the positioning hole.

11. The collapsible handle as claimed in claim 7, wherein the controlling button further has a positioning block integrally formed on the bottom face of the cap and the retaining element has a positioning hole defined to correspond to the positioning block such that the positioning block is able to be received in the positioning hole.

12. The collapsible handle as claimed in claim 8, wherein the controlling button further has a positioning block integrally formed on the bottom face of the cap and the retaining element has a positioning hole defined to correspond to the positioning block such that the positioning block is able to be received in the positioning hole.

13. The collapsible handle as claimed in claim 9, wherein the controlling button further has a positioning block integrally formed on the bottom face of the cap and the retaining element has a positioning hole defined to correspond to the positioning block such that the positioning block is able to be received in the positioning hole.

14. The collapsible handle as claimed in claim 9, wherein each of the at least two wedged legs engages with an outer face of the corresponding one of the at least two hooks so that the movement of the cap is able to force the at least two hooks to leave the corresponding set of notches to allow the tubular handle to slide relative to the inner tube.

15. The collapsible handle as claimed in claim 13, wherein each of the at least two wedged legs engages with an outer face of the corresponding one of the at least two hooks so that the movement of the cap is able to force the at least two hooks to leave the corresponding set of notches to allow the tubular handle to slide relative to the inner tube.

16. A collapsible handle in a shower head having a nozzle, the collapsible handle comprising:

a hollow tubular handle provided with a pair of oppositely formed tracks formed on an inner face of the tubular handle;

an inner tube selectively and slidably received in the tubular handle so that the inner tube is able to extend out of the tubular handle, the inner tube having a pair of oppositely formed ribs on an outer face of the inner tube to correspond to the pair of tracks such that after the ribs are received in the corresponding tracks, the inner tube is able to slide in and extend out of the tubular handle; and a retaining device movably mounted on the tubular handle to control the slidable movement of the inner tube relative to the tubular handle, wherein the retaining device comprises a controlling button movably mounted on the tubular handle and a retaining element driven by the controlling button, wherein the retaining element is sandwiched between the inner tube and the tubular handle, whereby a relative position between the inner tube and the tubular handle is determined by the retaining device so that an overall length of a handle of the shower head is able adjustable.

17. The collapsible handle as claimed in claim 16, wherein the controlling button includes:

a rectangular body;

a button formed on a mediate portion of the body;

an extension extending out from one distal end of the body and having a pair of cutouts oppositely formed on the extension.

18. The collapsible handle as claimed in claim 17, wherein the retaining element includes:

a hollow rim to correspond to the button;

a pair of first claws corresponding to the pair of cutouts of the extension and a pair of second claws oppositely extending relative to the first claws from the hollow rim to correspond to the notches, whereby when a user pushes the button to move the button in the hollow rim to have the first claws clamp the cutouts, relative position of the handle to the inner tube is changeable and therefore length of the sprinkler is changed, when the user pushes the button to move the button in the hollow rim to have the first claws to leave limit from the cutouts and to allow the rectangular body to be received between the two second claws, because the rectangular body blocks resilience between the two second claws, relative position between the handle and the inner tube is fixed.

* * * * *